US007013823B1

(12) United States Patent
Daugherty

(10) Patent No.: US 7,013,823 B1
(45) Date of Patent: Mar. 21, 2006

(54) AUTOMATIC WARNING FLAG SYSTEM FOR A WATER SKI BOAT

(76) Inventor: Jeff Daugherty, 2917 Smoke Tree Cir., Stockton, CA (US) 95209

( * ) Notice: Subject to any disclaimer, the term of this patent is extended or adjusted under 35 U.S.C. 154(b) by 0 days.

(21) Appl. No.: 11/103,240

(22) Filed: Apr. 11, 2005

(51) Int. Cl.
*B63B 21/04* (2006.01)

(52) U.S. Cl. ..... 114/253; 114/252; 116/173

(58) Field of Classification Search ..... 114/252, 114/253; 116/173
See application file for complete search history.

(56) References Cited

U.S. PATENT DOCUMENTS 3,602,188 A 8/1971 Penaflor
3,735,724 A 5/1973 Miller
3,786,778 A * 1/1974 Palmer et al. ..... 116/173
3,848,244 A 11/1974 Young et al.
4,640,213 A 2/1987 Lugo
4,782,784 A * 11/1988 Little ..... 116/173
4,871,996 A * 10/1989 Tsunamoto et al. ..... 114/275
4,934,972 A 6/1990 Shumway et al.
5,408,221 A 4/1995 Carsella, Sr. et al.
5,771,836 A 6/1998 Crouse

* cited by examiner

*Primary Examiner*—Lars A. Olson
(74) *Attorney, Agent, or Firm*—Jeffer Mangels Butler & Marmaro

(57) ABSTRACT

A mechanical warning flag system for a water ski boat. A first plate is coupled for rotation underneath the rope pylon. A second plate is coupled to the first plate and includes a vertical portion with an arcuate opening. A lever plate is pivotally coupled to the vertical portion of the second plate and includes a lever arm that receives one end of a bias spring and travels in the arcuate opening. The lever plate includes a pair of rope holders through which the tow rope is threaded. One rope holder is part of the pivotal connection, and the other is located on a distal portion of the lever plate. Since the lever arm is located between the rope holders, tension applied to the tow rope forces the lever plate downward thereby lowering the warning flag. In the absence of rope tension, a bias spring urges the lever plate upward to raise the warning flag.

2 Claims, 3 Drawing Sheets

AUTOMATIC WARNING FLAG SYSTEM FOR A WATER SKI BOAT

BACKGROUND OF THE INVENTION

This invention relates to a warning flag system for a water ski boat. More particularly, a warning flag is automatically raised by a mechanical apparatus when the tow rope goes slack.

According to boating regulations for the State of California and many other states, the operator of a vessel involved in towing a skier must display a ski flag to indicate any of the following conditions: a downed skier; a skier in the water preparing to ski; a ski line extended from the vessel; or a ski in the water in the vicinity of the vessel. Most simply, a spotter sits in the boat holding a flag, and when any of these conditions occur, the spotter raises the flag to alert other vessels of the condition.

Various mechanical systems for flag raising have also been tried, including U.S. Pat. No. 3,735,724 and U.S. Pat. No. 5,771,836. However, these devices are unnecessarily complex for such a simple task. Thus, it would be desirable to have a simple mechanical actuator that automatically raises a warning flag at the appropriate time.

SUMMARY OF THE INVENTION

The present invention provides a mechanical warning flag system for automatically raising a warning flag when the tow rope coupled to a rope pylon on the ski boat goes slack. A first plate is installed so as to pivot around the base of the rope pylon, either as an item of original manufacture or as a retrofit. A second plate is coupled to the first plate and includes a vertical portion with an arcuate opening. A lever plate is pivotally coupled to the vertical portion of the second plate and includes a lever arm that receives one end of a bias spring and travels in the arcuate opening of the second plate. The lever plate is normally biased into an upright position such that when the tow rope is slack, the warning flag is raised. The lever plate includes a pair of eyelets or rope holders that receive the tow rope, one as part of the pivotal connection, and the other located on a distal portion of the lever plate. The lever arm is located between the pair of eyelets. When tension is applied to the tow rope, the lever plate is forced downward thereby lowering the warning flag. The lever arm is forced down in the arcuate opening loading the bias spring which will then force the lever plate up and raise the flag once the tow rope goes slack.

DETAILED DESCRIPTION OF THE INVENTION

Figure 1:
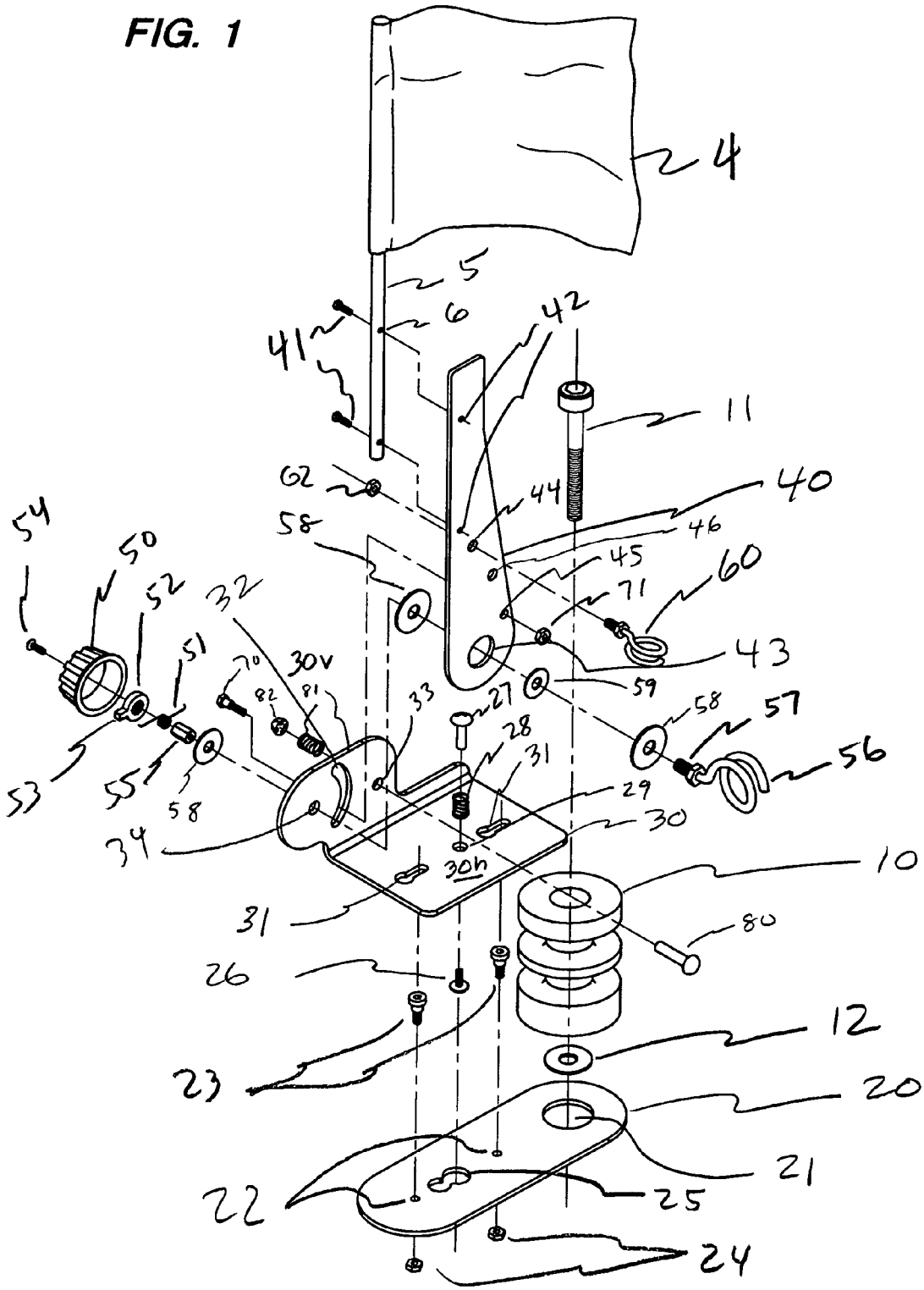
FIG. 1 is an exploded perspective view showing the component parts of the present invention.
Figure 2:
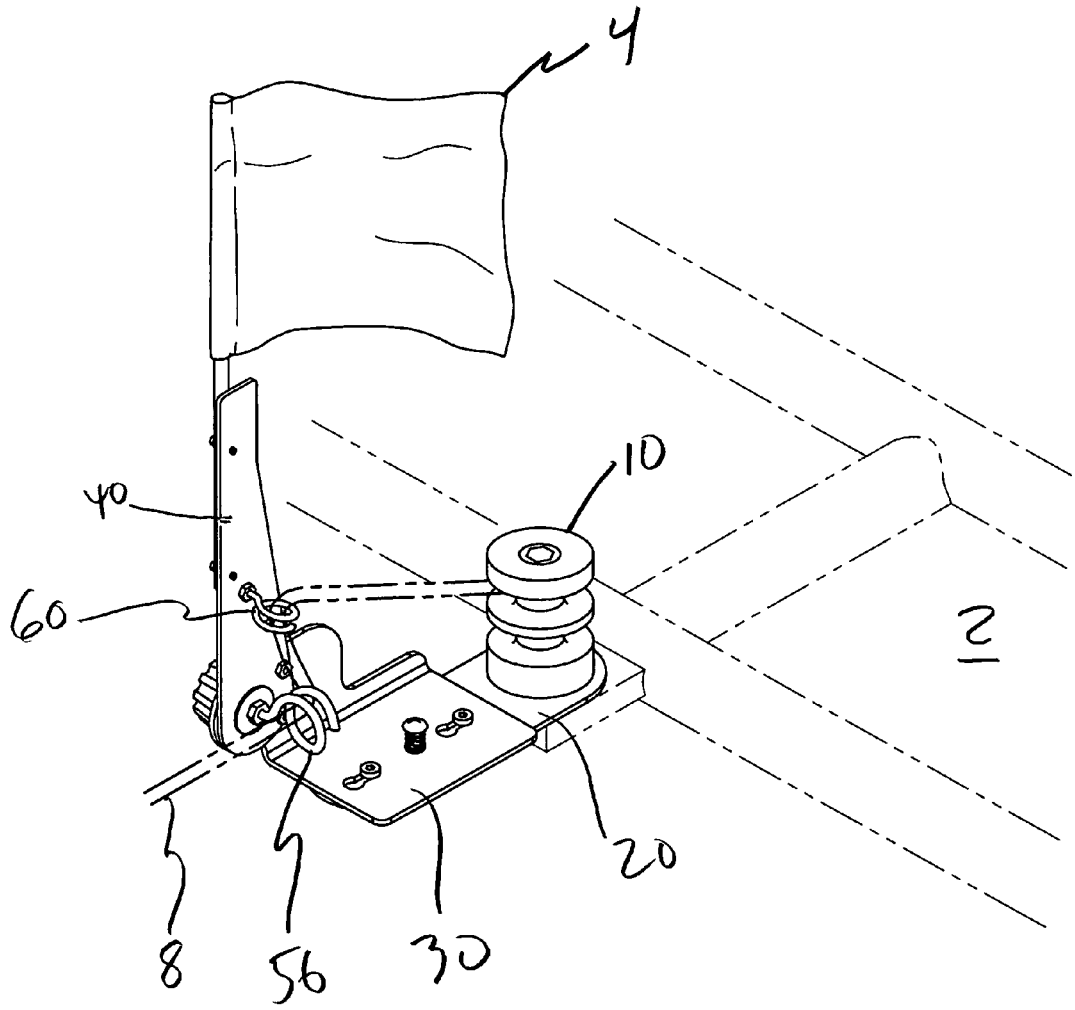
FIG. 2 is a perspective view showing the ski flag in the raised position as a result of slack in the tow rope.
Figure 3:
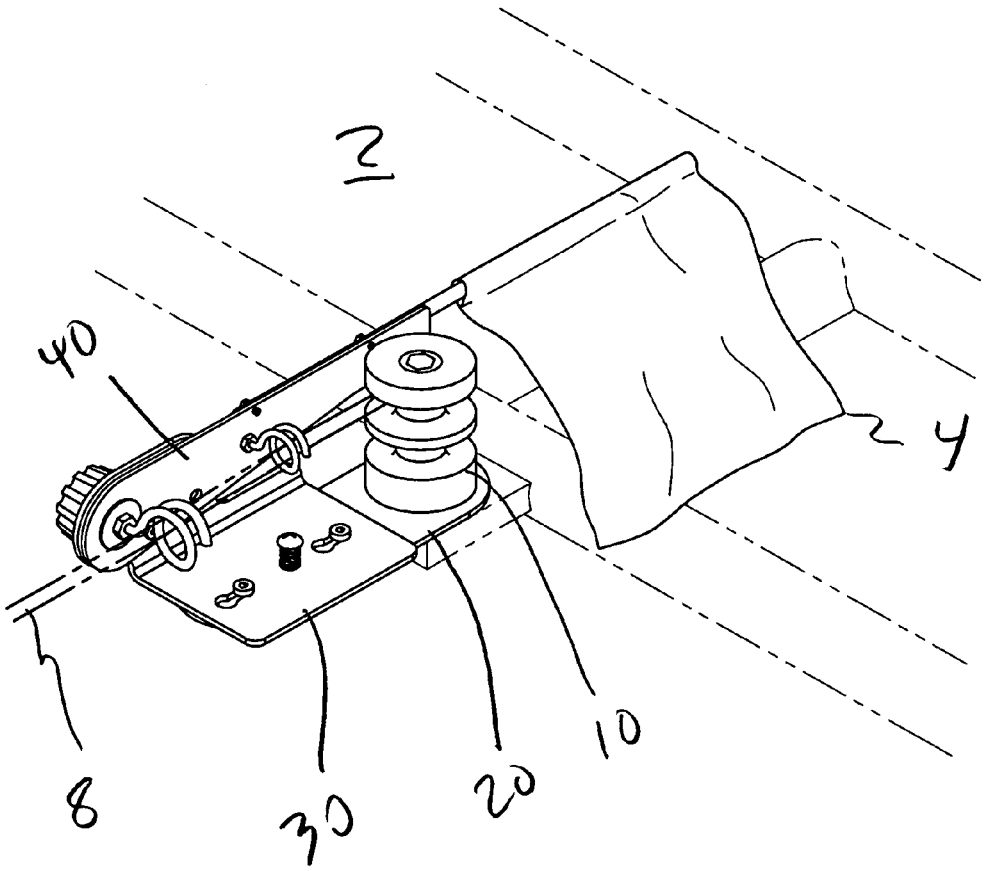
FIG. 3 is a perspective view showing the ski flag in the down position as a result of tension in the tow rope.

A preferred embodiment of a water skier warning flag system in accordance with the present invention is illustrated in FIGS. 1–3. As best seen in FIGS. 2–3, a rope pylon 10 is mounted to an appropriate fixture of a power boat 2 for receiving and securing a tow rope 8 (shown in dashed lines). In accordance with the invention, when the skier is up and the tow rope is in tension, the flag 4 is down, as shown in FIG. 3. When the skier is down and the tow rope is slack, the flag is up, as shown in FIG. 2.

Typically, the rope pylon 10 is bolted directly onto the stern, or to another appropriate fixture or tower that is advantageously positioned on the boat. In the preferred embodiment, as best shown in FIG. 1, a support plate 20 is installed to pivot underneath the rope pylon 10. The support plate 20 is made from flat ¼ inch stainless steel stock and measures approximately 3 inches wide by 6 inches long with rounded corners. A large opening 21 (approximately ¾ inches diameter) in one end allows the rope pylon 10 to be secured to the boat attachment point with threaded bolt 11 through the rope pylon 10 and pivot washer 12. The pivot washer 12 is stainless steel of sufficient thickness and diameter to hold the rope pylon 10 on top of the support plate 20, and thereby permit pivoting rotation of the support plate 20 relative to the attachment point allowing the entire flag assembly to pivot back and forth to follow the skier.

The support plate 20 includes a pair of holes 22 for receiving shoulder bolts 23, which are secured to the support plate with nylon locking nuts 24. The base plate 30 includes two holes with elongated slotted openings 31 that receive the heads of the shoulder bolts 23. The base plate 30 also contains a coupler locking assembly comprised of barrel nut 27, compression spring 28 and a locking screw 26. The barrel nut 27 is slipped through the compression spring 28 and inserted through hole 29 that is of sufficient size so as to allow the barrel nut to pass unrestricted while trapping the compression spring between the head of the barrel nut and the top surface of the base plate. The locking screw 26 is threaded into the barrel nut 27 from the underside of the base plate 30, leaving only the exposed head of the locking screw 26. The attached assembly has sufficient spring loading so as to maintain positive contact between the locking screw 26 and the bottom surface of the base plate 30. When mating the base plate 30 to the support plate 20, the coupler locking assembly screw head 26 is aligned with the forward hole of opening 25 in the support plate and the shoulder bolts 23 are aligned with the round portion of the elongated slotted openings 31 of the base plate.

The base plate 30 is also made from flat ¼ inch stainless steel stock and includes a horizontal portion **30*h*, and a vertical portion 30*v* which is bent to form a right angle with the horizontal portion. As noted above, the horizontal portion 30*h* includes elongated slotted openings 31 sized to receive the head of shoulder bolts 23. Depressing the coupler locking assembly plunges the neck of the barrel nut 27 into the front hole of opening 25 in the support plate 20 allowing the head of the locking nut 26 to clear the bottom surface of the support plate. The space connecting the forward hole and rear hole of the opening 25 in the support plate 20 is sufficient in size to allow the neck of the barrel nut to pass from the front to rear hole while sliding the base plate 30 rearward. The slotted portion of openings 31 slide beneath the heads of the shoulder bolts 23. Releasing the coupler locking assembly returns the locking screw head 26 to the bottom surface of the base plate 30 and positively secures the base plate from further movement. Depressing the coupler assembly allows the base plate to slide forward, realigning the heads of shoulder bolts 23 with the round portion of slotted openings 31 to permit removal of the base plate 30** and flag assembly.

The vertical portion **30*v* extends upward at a right angle from the horizontal portion 30*h* and includes an arcuate opening 32 and two small round openings 33 and 34**.

A rigid lever plate 40 is pivotally coupled to the vertical portion **30*v* of the base plate 30. The lever plate 40 is also made from ¼ inch stainless steel stock, and measures approximately 2 inches wide by 6 inches long, with a preferred shape as shown—slightly larger at the lower end, and gradually smaller to the distal or flag-holding end. A flag 4 is affixed to distal end of the lever plate 40 by bolting the flagpole 5 directly to the plate 40, e.g. by using machine screws 41 through openings 6 in the flag pole and into threaded openings 42** in the lever plate.

The lever plate 40 is secured to the vertical portion 30*v* of the base plate 30 by a pivotal connection coupled through opening 43 in the lever plate and opening 34 in the base plate. The pivotal connection includes a pivot washer 59, slightly thicker than the lever plate and slightly smaller in diameter to the lever plate pivot hole 43. The pivot washer 59 is sandwiched in place by two larger diameter washers 58. The threaded portion of rope holder 56 is inserted through the center of this pivot assembly and through hole 34 from the interior side of the vertical portion of the base plate 30*v*. Another washer 58 is installed onto the protruding threaded portion of the rope holder on the exterior side of the base plate 30*v* and the entire mechanism is secured in place by a threaded hex nut coupler 55. The securely attached lever plate 40 now pivots freely along its vertical axis. The bias spring 51 is inserted over the hex coupler nut 55 and is held in place by sliding the tensioner cam 52 onto the hex nut. The tensioner cam has hex aligment notches to allow fixed rotational settings. The tensioner cam tab 53 is notched to receive one end of the bias spring. The bias spring 51 tension can be adjusted by setting the tensioner cam at any one of its rotational stops. The cover cap is placed over the entire bias and lever arm mechanism and secured to the base plate 30*v* by screw 54 threaded into hex nut coupler 55. The rope holder has a helical shape to allow inserting and removing the tow rope as necessary, without detaching the tow rope from the pylon, and holding the tow rope through the helix during normal operation.

A second helical rope holder 60 is secured to the lever plate 40 with a threaded portion 61 through opening 44 and secured by nut 62.

A shoulder bolt 70 is inserted through the arcuate opening 32 in the base plate and secured to the lever plate through opening 45 with nut 71. The shoulder bolt 70 acts as the lever arm to which one end of bias spring 51 is attached. The shoulder bolt 70 follows long the shape of the arcuate opening during operation and also acts as a stop for the both upper and lower travel limits of the lever plate 40.

A clevis pin 80 is inserted through the interior side of opening 33 of the base plate 30*v*. Compression spring 81 is placed over the clevis pin post from the exterior side of the base plate 30*v* and is held in place by nut cap 82. This mechanism, while the flag is in the down position, can be depressed thereby plunging the head of the clevis pin 80 through opening 46 in the lever plate 40. Friction created by the biased upward moment of the lever plate 40 and the lip of the clevis pin prevents the pin from retracting thereby retaining the lever plate in the down position. Tension applied to the tow rope relieves this upward moment of the lever plate that allows the clevis pin to retract from the lever plate opening 46 and releases the lever plate to move unrestricted.

Now the operation of the warning flag system will be described. As shown in FIG. 2, the free end of tow rope 8 is threaded through helical rope holders 56 and 60 and secured to the rope pylon 10. Since in this figure there is no tension on the rope 8, the bias spring 51 in the actuator assembly holds the lever plate 40 in an upright position, i.e. to raise the flag.

When tension is applied to the tow rope 8, as in FIG. 3, due to a skier pulling on the handle end of the tow rope, the lever arm 40 is rotated down and forward, with shoulder bolt 70 moving downward in the arcuate opening 32, which rotationally loads the bias spring.

When the skier falls or drops, the tow rope goes slack, and the bias spring rotationally unloads bringing the lever plate into its upright position to raise the flag.

As can be appreciated, a key feature of the present invention is its simplicity and ability to function without operator intervention. This is achieved by having the flag mounted on a pivoting lever plate that is located close to the rope pylon making it conspicuously visable. Tension on the tow rope through an eyelet fixed to one end of the lever plate causes the lever plate to rotate and thereby lower the warning flag. In the absence of tension on the tow rope, the lever plate is spring-biased to maintain the flag in the up position.

A distinctive feature of this particular invention is that there is NO ATTACHMENT OF THE TOW ROPE TO THE MECHANISM. The tow rope is easily threaded through eyelets or rope holders affixed to a lever arm, and rotational movement is created by the tension of the rope and bias spring, thus allowing for such a simplistic and lightweight design.

Advantageously, a form of the present invention could be easily retrofitted as an after market accessory, or originally manufactured as an integral part of the rope pylon or tower. These and other advantageous features will be appreciated by considering the foregoing disclosure and the claims that follow.

What is claimed is:

1. A warning flag system for boating, wherein a rope pylon is rigidly affixed to a boat and adapted for securing a tow rope thereto, comprising:

a support plate mounted to the rope pylon;

a base plate affixed to the support plate including a horizontal portion and a vertical portion, wherein the vertical portion includes an arcuate opening;

a lever plate pivotally connected at a proximate end thereof to the vertical portion of the base plate and having a first rope holder near the pivotal connection, a second rope holder away from the pivotal connection, and a lever arm portion located between the first and second rope holders and adapted to travel in the arcuate opening of the base plate, and wherein a warning flag is attached to the lever plate and extends from a distal end thereof; and a biasing mechanism urging the lever plate toward an upright position;

wherein a tow rope is threaded through the first and second rope holders, and wherein tension on the tow rope causes the lever plate to rotate about the pivot point against the urging of the biasing mechanism with the lever arm traveling downward in the arcuate portion, and wherein the release of tension on the tow rope causes the biasing mechanism to urge the lever plate toward an upright position with the lever arm portion traveling upward in the arcuate portion.

2. A warning flag system for boating, wherein a rope pylon is rigidly affixed to a boat and adapted for securing a tow rope thereto, comprising:

a first plate coupled for rotation underneath the rope pylon;

a second plate coupled to the first plate and having a vertical portion, wherein the vertical portion includes an arcuate opening;

a lever plate pivotally connected to the vertical portion of the second plate and having a lever arm portion adapted for travel in the arcuate opening of the second plate;

a first rope holder affixed to the lever plate at the pivotal connection; and a second rope holder affixed to the lever plate distal from the pivotal connection, wherein the lever arm portion is located between the first and second rope holders.

* * * * *